US005909968A

United States Patent [19]

Olin et al.

[11] Patent Number: 5,909,968

[45] Date of Patent: Jun. 8, 1999

[54] VACUUM TOILET UNIT

[75] Inventors: Henry Olin, Espoo; Gunner Lindroos, Helsinki; Roland Mattsson, Espoo, all of Finland

[73] Assignee: Evac International Oy, Helsinki, Finland

[21] Appl. No.: 08/889,620

[22] Filed: Jul. 7, 1997

[30] Foreign Application Priority Data

Jul. 9, 1996 [FI] Finland ..... 962791

[51] Int. Cl.[6] ..... E03D 11/00

[52] U.S. Cl. ..... 4/431; 4/252.2; 4/420

[58] Field of Search ..... 4/420, 431–433, 4/252.2, 252.3, 252.1, 300

[56] References Cited

U.S. PATENT DOCUMENTS

| | | | |
|---|---|---|---|
| 3,591,868 | 7/1971 | Owens | 4/420 X |
| 4,041,554 | 8/1977 | Gregory et al. | 4/420 |
| 5,231,706 | 8/1993 | Kendall | 4/420 X |

FOREIGN PATENT DOCUMENTS

| | | | |
|---|---|---|---|
| 0 584 031 | 2/1994 | European Pat. Off. . | |
| 0 659 945 | 6/1995 | European Pat. Off. . | |
| 1354106 | 10/1964 | France . | |
| 44 13 493 | 10/1994 | Germany . | |
| 9 102 014 | 6/1993 | Netherlands . | |
| 2244729 | 12/1991 | United Kingdom | 4/420 |
| 94/10397 | 5/1994 | WIPO . | |
| 98/02079 | 1/1998 | WIPO . | |

*Primary Examiner*—Charles E. Phillips
*Attorney, Agent, or Firm*—Smith-Hill and Bedell

[57] ABSTRACT

A vacuum toilet unit comprises a toilet bowl, an operating mechanism for the toilet function, and an outer shell enclosing both the toilet bowl and the operating mechanism. In normal use of the toilet unit, substantially all of the externally applied load exerted by a user of the toilet is carried by the shell. In order to allow service access to the bowl and operating mechanism, at least a substantial portion of the shell is removable without any substantial influence on the support of the bowl or operating mechanism.

19 Claims, 5 Drawing Sheets

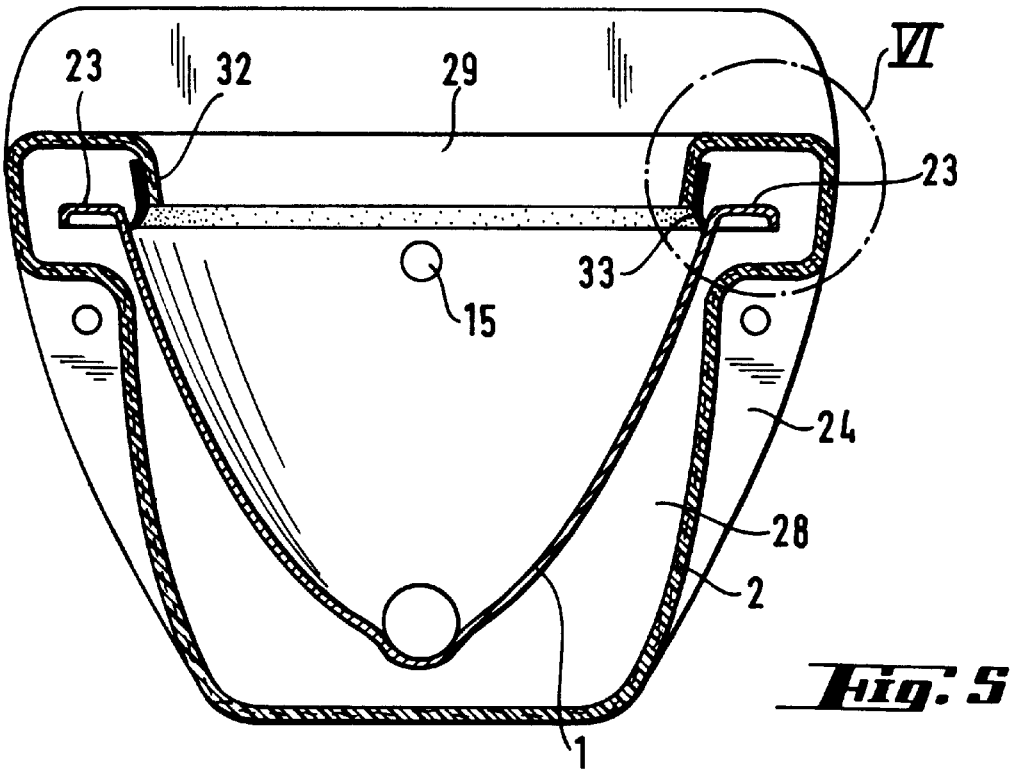
Fig. 5
Fig. 6
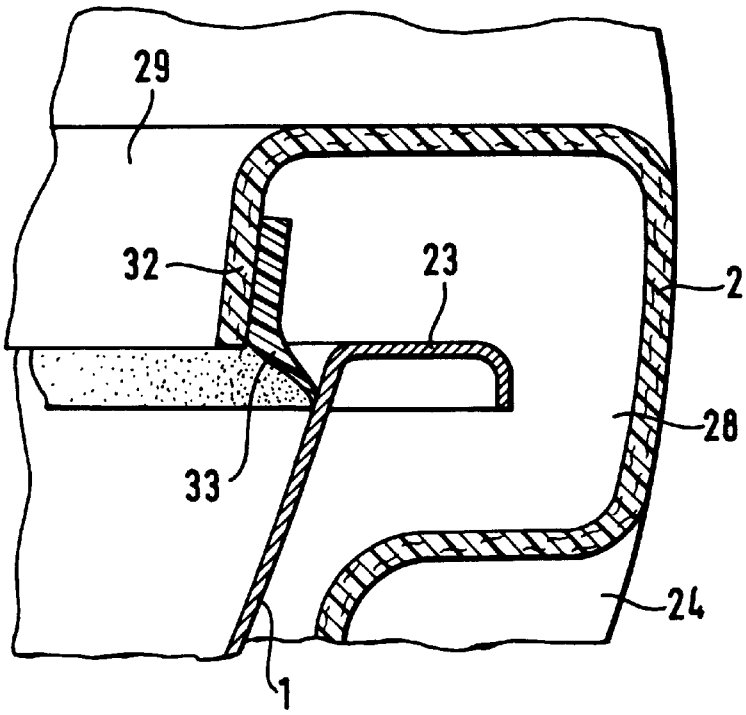

VACUUM TOILET UNIT

BACKGROUND OF THE INVENTION

This invention relates to a vacuum toilet unit.

In a vacuum toilet system, otherwise known as a vacuum sewer system, a normally-closed discharge valve (or sewer valve) is connected between the outlet of the toilet bowl and the sewer pipe, and a vacuum pump, for example a blower or ejector, is used to establish a considerable pressure difference (typically about 0.3 to 0.5 bar) across the discharge valve. The pressure difference may be established by maintaining the vacuum sewer continuously under partial vacuum or it may be generated in connection with initiating each emptying operation of the toilet bowl. When the discharge valve is opened in response to a flush command, the contents of the toilet bowl are forced almost instantaneously into the sewer pipe and are propelled in plug form at high speed along the sewer pipe towards a sewage collection container. In some instances, the sewage collection container itself is placed under vacuum, and in others, it is not. It will therefore be appreciated that a vacuum toilet functions differently from a conventional water toilet, in which water flowing into the toilet bowl under gravity both removes waste from the toilet bowl and cleans the toilet bowl. A vacuum toilet uses air as a waste transport medium. Generally, a small amount of rinse water is supplied to the toilet bowl in connection with the emptying operation for cleaning the toilet bowl.

A vacuum toilet must include an actuator for its sewer valve and a rinse water supply device together with means for controlling the sewer valve actuator and the rinse water supply device and for adjusting the operation of the sewer valve actuator and the rinse water supply device. Further, starting means for the rinsing and the emptying operation and various safety means, for example means preventing the sewer valve from opening if there is not enough vacuum in the sewer, are required. As a result of all this a vacuum toilet needs more maintenance than a conventional water toilet. It is desirable that all the operation and control means of the toilet should be integrated with the toilet bowl in a toilet unit. Accordingly, the toilet unit must be so built that the operation and control means can easily be maintained in spite of a narrow or otherwise restricted mounting space.

U.S. Pat. No. 5,133,853 mentions that a vacuum toilet may have an outer shell. According to the description, it is of advantage to place all the devices required inside the shell. In this known design maintenance of the toilet has been difficult, because diverse devices have not been accessible without quite a large dismounting.

SUMMARY OF THE INVENTION

In accordance with the present invention there is provided a vacuum toilet unit comprising a toilet bowl, an operating means for the toilet function, and an outer shell enclosing both the toilet bowl and the operating means, wherein at least a substantial portion of the shell is removable without any substantial influence on the support of the bowl or operating means, in order to allow service access to the bowl and operating means, and in normal use of the toilet unit, substantially all of the externally applied load exerted by a user of the toilet is carried by the shell.

The object of the invention is to provide a vacuum toilet unit, in particular a light-weight toilet unit, in which all the necessary operating devices can be enclosed into the toilet unit itself, but providing nevertheless easy service access. Also, a vacuum toilet unit according to the invention is more advantageous than known vacuum toilet units from the point of view of manufacture.

One problem to be solved is that some parts of the toilet shell must be dismantled for allowing service access to the toilet's operating means. The toilet bowl and the operating means, hereinafter the interior elements, must be supported during service. In accordance with the invention, this can be accomplished in two somewhat different ways.

One possibility is to have one basically stationary or fixed part of the toilet shell arranged so that it supports the interior elements during service and also takes up all the external load imposed on the toilet during normal use thereof. If the shell is designed as a support for the interior elements, the toilet unit comprises three main components: a bowl-supporting shell part, a toilet bowl and other interior elements supported thereby and a detachable part of the shell. Because only one part of the shell is a supporting part, it follows that the detachable part of the shell can be easily removed, whereby the interior elements are made accessible. By suitably designing both parts of the shell, no fixing means, such as screws or the like, are needed to keep them properly together and accordingly no tools are needed to remove the detachable part of the shell.

Supporting the bowl by means of one part of the shell gives secure support with simple means. The bowl, which is rigid, can conveniently be supported at its rim and the support provided to the bowl is transmitted by the bowl to the other interior elements. All external loads acting on the toilet bowl will be directed to the rim of the bowl and will be conveniently taken up by the support arrangement.

The upper part of the shell may be the bowl-supporting part, for example a part fastened to the wall, and the lower part of the shell is then the detachable part. A considerably more advantageous solution is obtained if the lower part of the shell is the supporting part, supporting both the toilet bowl and the upper part of the shell. In this case, the upper part of the shell may be mounted as a detachable cover over the lower part of the shell, so that a tidy and smooth appearance is obtained, and the upper part can be removed by lifting it off the lower part.

From the point of view of the appearance it is of advantage that at the lower edge of the upper part of the shell there is a lip covering the division line of the shell.

If the lower part of the shell is the supporting part, it is of advantage that its upper edge is formed as a flat support surface, from which the toilet bowl and the upper part of the shell can receive their support. The toilet bowl is preferably provided, at or in the vicinity of its upper edge, with a flange-like part, which fits on the flat support surface. The toilet bowl and the lower part of the shell can be locked to one another by gluing or by attachment members, because the toilet bowl does not normally need to be removed from the supporting part of the shell.

At the upper edge of the toilet bowl there usually is a flush annulus in the form of an annular space closed upwards and sideways but open downwards, from which rinse water flows into the toilet bowl. Keeping the annular space clean is usually difficult, but, according to one aspect of the invention, if the upper part of the shell is detachable it can be shaped so that it includes a skirt extending downward into the toilet bowl, inward of the upper edge of the toilet bowl, and forming together with the top of the wall of the toilet bowl the flush annulus. When the upper part of the shell is lifted off, the interior of the flush annulus is made totally free and can be easily cleaned.

Another possibility is to support the interior elements by light support means only, i.e. support means dimensioned to take up the weight of the interior elements only and not a substantial external load. These light support means are then sufficient for holding the interior elements in their proper place. The shell should then be so designed that it has no essential load transmitting contact with the interior elements and is able to support all external loads acting on the toilet unit in normal use of the toilet bowl without transmitting any essential part thereof to the light support means of the interior elements.

In this alternative case, no external load is transmitted to the bowl from the shell. The interior elements may then be held only by the light support means, which makes it possible to easily design the interior elements in the form of a single assembly block, ready made and tested at the factory. The entire shell, or a part of it, if so desired, can then easily be mounted or removed, because no load transmitting contact surfaces between the shell and the interior elements are needed. Further, since the interior elements do not require any heavy support means the weight of the interior elements and their support means can be kept to a minimum.

The described support arrangements provide substantial advantages.

The invention may be advantageously applied so that all the interior elements are inside the shell, but the invention may also be applied so that some of the interior elements are in a space behind the toilet bowl, to which space access is provided by dismantling a detachable part of the shell or by removing the entire shell.

The toilet unit is preferably made for attachment to a wall. Depending on the strength of the shell, the lower part of the toilet may be at a distance from the floor or the shell may also be supported by the floor. In both cases, it is of advantage to form the support part of the shell so that it includes, at its back, a rigid attachment flange, preferably an inwardly extending flange, which is fixed to the wall. In other respects, the back of the shell may be open which reduces the weight of the toilet unit. As a third possibility, the toilet unit may attached only to the floor, without any connection to a wall.

It is of advantage that, in the upper part of the shell, there is attached, preferably hinged, a seat ring and possibly also a closable cover. In particular, if the upper part of the shell is a detachable part, different upper parts of the shell may at will be combined with a standard-type lower part of the shell. Thereby different toilet models are created. They may have a different seat ring and a different cover, and the upper part of the shell may also otherwise be differently formed in different models.

For producing a light toilet unit, it is of advantage to make the shell from fiber-reinforced plastic, for example from glass-fiber reinforced plastic.

BRIEF DESCRIPTION OF THE DRAWINGS

In the following, the invention is described more in detail with reference to the accompanying drawings, in which, FIG. 1 schematically shows a side view of a first vacuum toilet unit according to the invention, FIG. 2 schematically shows the vacuum toilet unit of FIG. 1 viewed from behind, FIG. 3 schematically shows a top view of the vacuum toilet unit of FIG. 1 with the upper part of the shell lifted off, FIG. 4 schematically shows a perspective exploded view of a second vacuum toilet unit according to the invention, FIG. 5 is a sectional view of the toilet unit shown in FIG. 4, and FIG. 6 is an enlarged view of the detail designated VI in FIG. 5.

DETAILED DESCRIPTION

Figure 1:
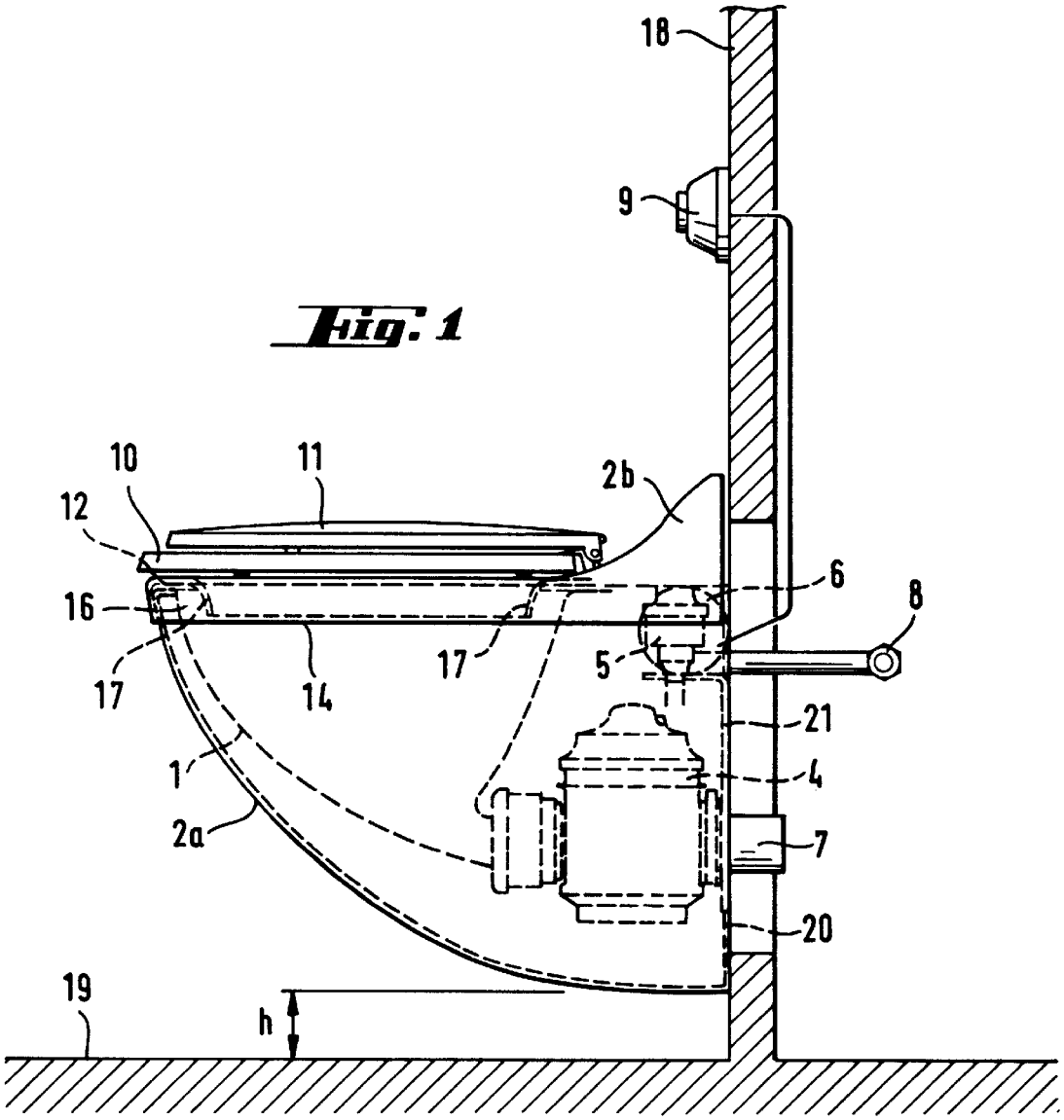
Figure 2:
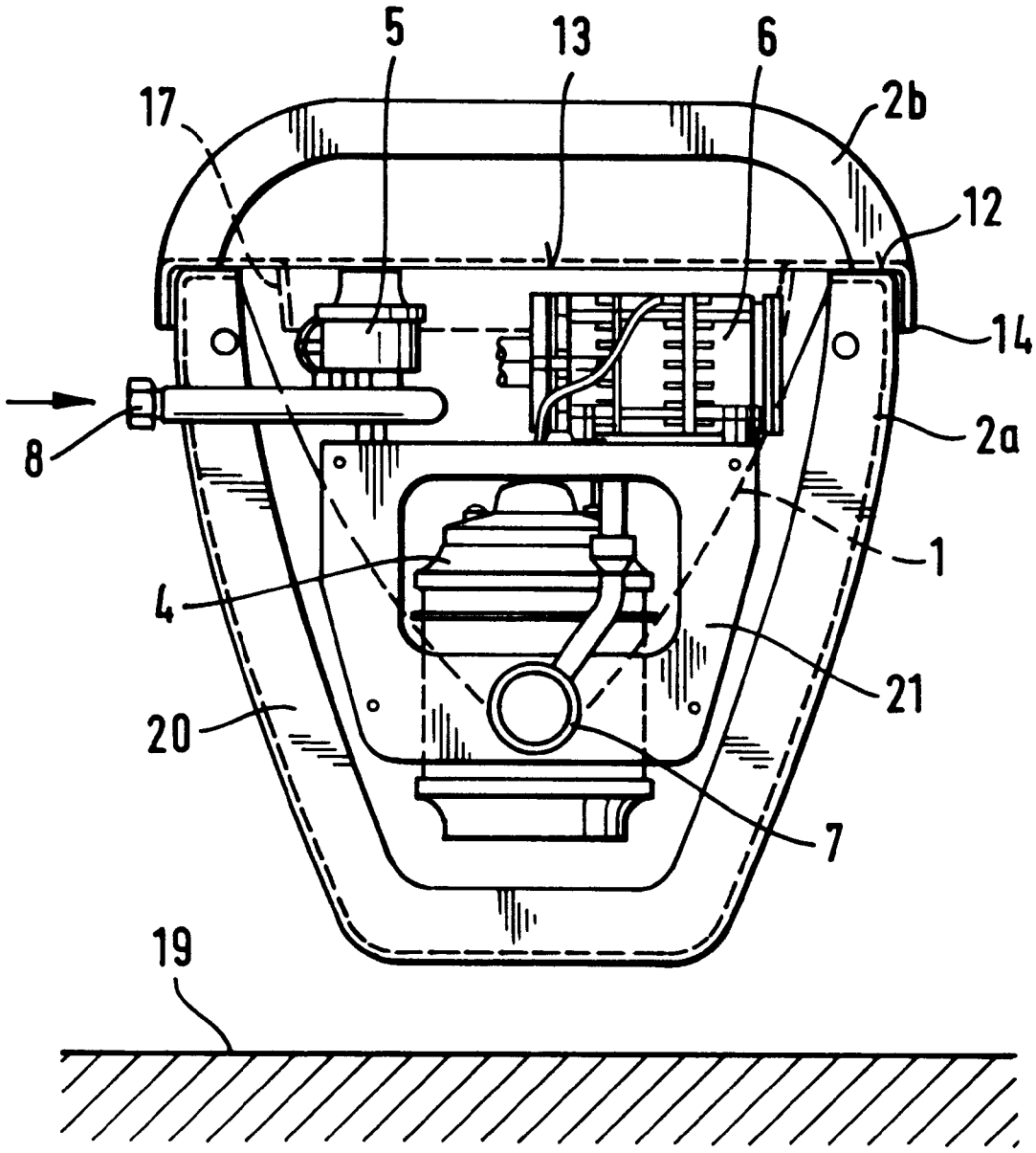
Figure 3:
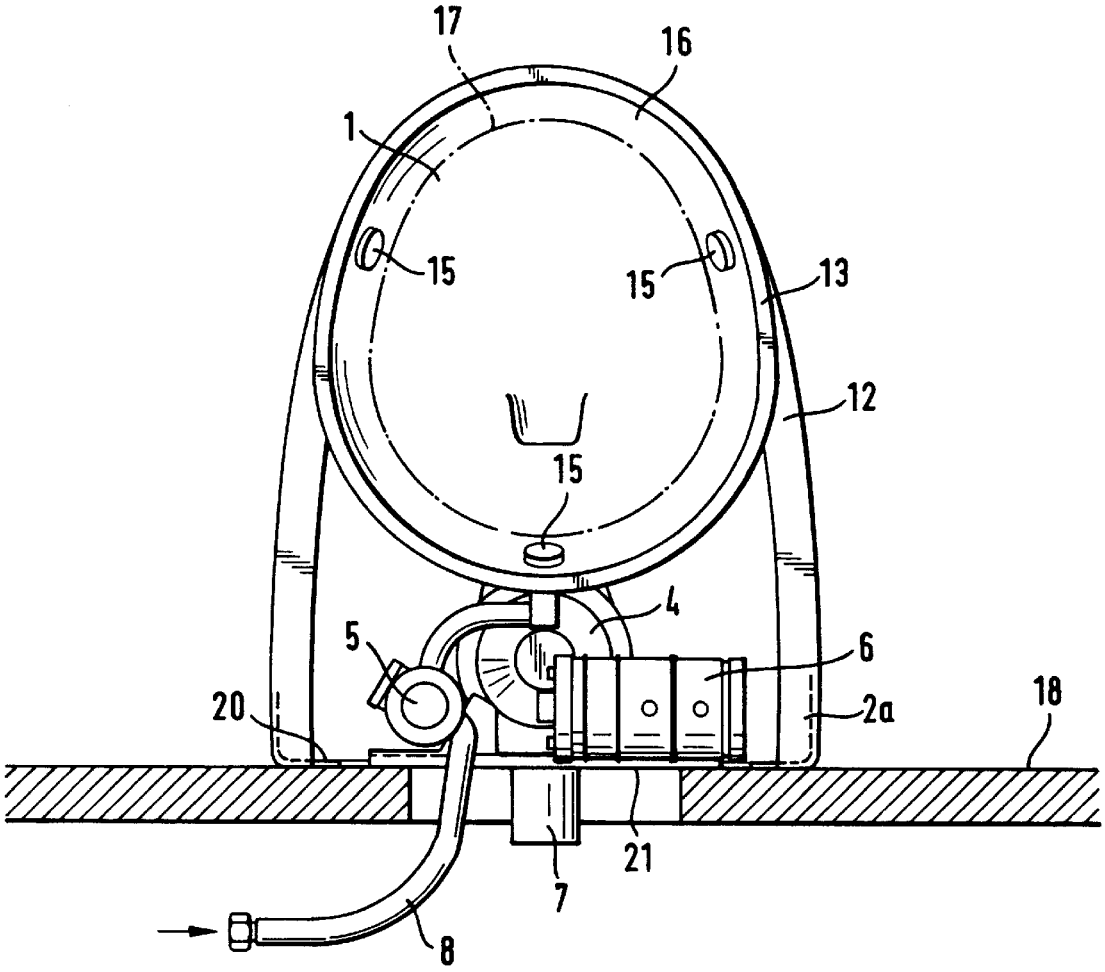

In the toilet unit illustrated in FIGS. 1–3, 1 indicates a toilet bowl, 2*a* a lower supporting part of a shell surrounding the toilet bowl and 2*b* a detachable upper part of the shell. The toilet unit includes a sewer valve 4 closing the outlet opening of the bowl, a dosing device 5 for feeding rinse water, to which device a rinse water supply pipe 8 is connected, and a flush control unit 6 for controlling operation of the devices 4 and 5. The components 4, 5 and 6 are shown only in outline in FIG. 1 and are seen more fully in FIGS. 2 and 3.

The toilet unit shown in FIGS. 1–3 is a so-called wall model fastened to a wall 18 and totally clear of the floor surface 19. The distance h between the toilet shell and the floor surface may be, for example, 4–5 cm. At the rear of the supporting part 2*a* of the shell there is an inwardly going flange 20, by means of which this part of the shell is attached to the wall 18. The devices 4, 5, and 6 are fastened to a mounting plate 21, which during the assembly of the toilet unit may be fastened to the wall 18. The plate 21 may also be fastened to the lower part 2*a* of the shell, for example to the flange 20. Behind the sewer valve 4 there is a short pipe 7 which extends through a hole in the wall 18 and is directly connectable to a vacuum sewer. A seat ring 10 and a toilet bowl cover 11 are hinged to the upper part 2*b* of the shell. The emptying and rinsing operation of the toilet is started by pressing a flush knob 9, which may be in the wall 18, as shown in FIG. 1, or in the upper part 2*b* of the shell behind the cover 11.

At the upper edge of the supporting part 2*a* of the shell a level support surface 12 is formed, on which both a flange 13 formed at the upper rim of the toilet bowl 1 and the detachable upper part 2*b* of the shell are placed. The toilet bowl 1 is fixed and supported on the lower part 2*a* of the shell only by means of its flange 13. At the lower edge of the upper part 2*b* of the shell there is an outer lip 14, which covers the division line between the shell parts 2*a* and 2*b*.

For servicing the devices 4, 5, and 6, the upper part 2*b* of the shell is lifted off the support surface 12. At this time the space behind the toilet bowl opens up, in which space the service requiring devices 4, 5 and 6 are situated. The devices 4, 5, and 6 are then readily accessible and they may be removed or may be serviced in place.

Rinse water is led from the rinse water dosing device 5 to at least three rinse water nozzles 15, from which the water is sprayed on the inner surface of the toilet bowl with such a force that the inner surface is cleaned. The rinse water nozzles 15 are accommodated in a flush annulus 16, which is limited at its interior by an inner skirt 17 of the upper part 2*b* of the shell. The skirt 17 is spaced from the inner surface of the bowl and extends a short distance downwards into the toilet bowl from the rim of the toilet bowl. When the upper part 2*b* of the shell is lifted off, the flush annulus becomes totally open.

The function of the devices 4, 5, 6, 8 and 9 is not described in detail, because these devices are known per se.

Figure 4:
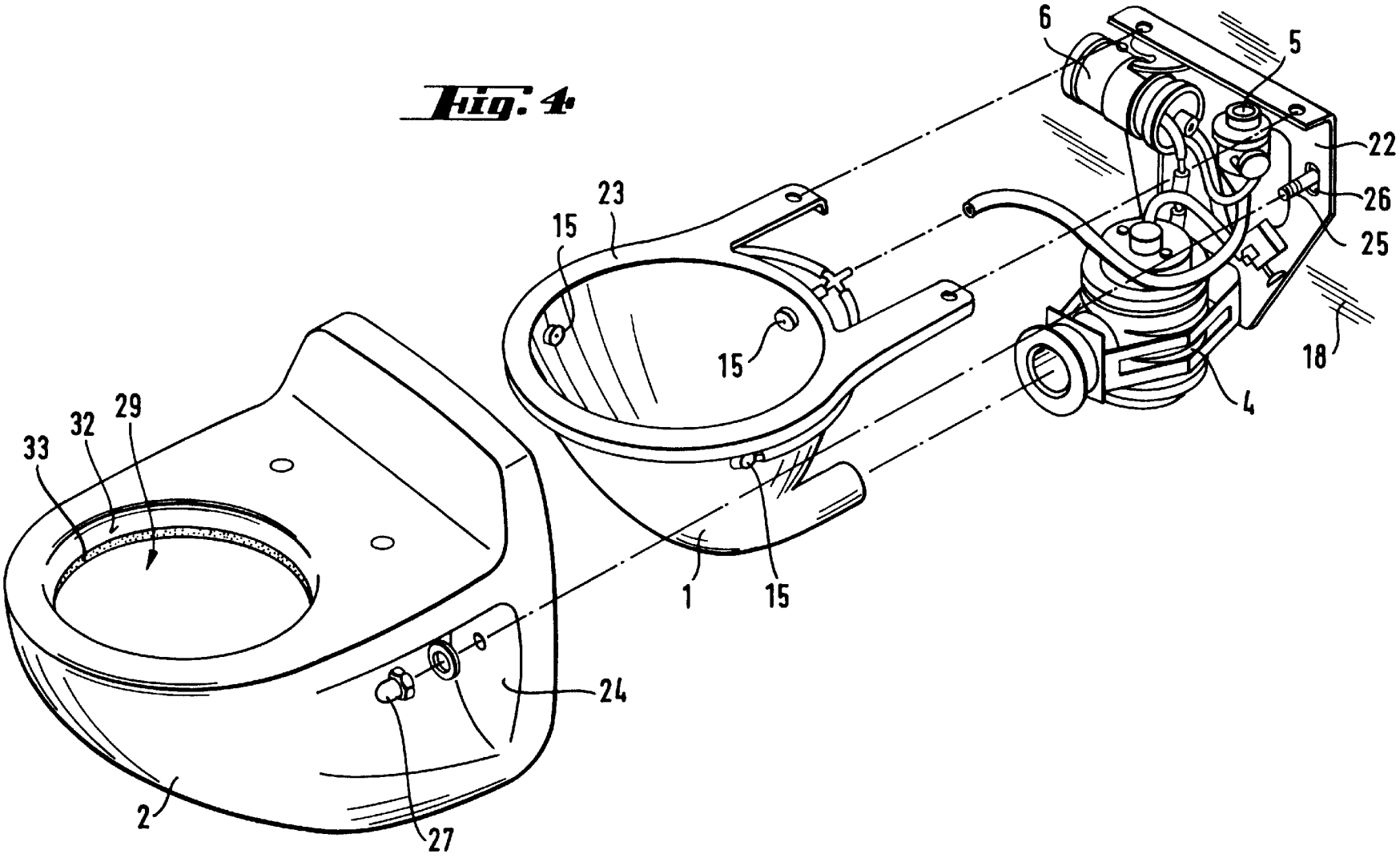

Referring to FIGS. 4–6, the bowl 1 is formed by deep drawing a plane stainless steel plate. The edges of the plate are held firmly during the deep drawing operation and form a rim plate 23 having arms which extend backwards relative to the bowl. The bowl 1 and the other interior elements 4, 5, 6 receive sufficient light support from a base plate 22 which is attached to a wall behind the toilet. The bowl receives extra support at its rim from the arms of the rim plate 23, which also are attached to the base plate 22. The attachments to the base plate 22 supports the interior elements, but are not dimensioned to support the load of a user of the toilet.

The shell 2, here shown without seat and cover, is undivided, i.e. it is in one piece, and has a strong attachment flange 24 held by strong bolts 25 attached through openings 26 in the plate 22 to the wall behind the plate 22. Other parts of the back side of the shell 2 receive support outside the base plate 22 directly from the wall behind the plate 22. The shell 2 defines an internal cavity 28 which encloses the toilet bowl 1, including the rim plate 23, and the other interior elements when the shell is attached to the wall. The shell has an opening 29 slightly narrower than the bowl at its upper rim. The opening 29 is surrounded by an internal skirt 32 extending downward from the edge of the opening 29. The shell 2 is demounted from the wall by removing the nuts 27 from the bolts 25 and displacing the shell horizonatally away from the wall, perpendicular to the plane of FIG. 5, while the interior elements remain attached to the wall. By removing the entire shell 2, the interior elements are in the best possible manner accessible for service. The shell is replaced by displacing it horizontally toward the wall and replacing the nuts on the bolts 25.

When the shell 2 is attached to the wall, the shell is not in load transmitting contact with the interior elements. There is sufficient clearance between the shell and the toilet bowl 1 to allow limited downward deflection of the shell relative to the bowl when the shell is under an external load in normal use without contacting the bowl and transmitting load to the bowl and the other interior elements. Thus, the toilet bowl 1 is positioned beneath the toilet bowl seat but the weight of the user of the toilet unit is supported by the shell 2 and its attachment to the wall.

A soft rubber lip 33 is attached to the outside of the skirt 32 and seals against the interior of the bowl 1 when the shell 2 is attached to the wall. The rubber lip provides an adequate seal between the cavity 28 and the toilet bowl 1 while permitting limited downward deflection of the shell relative to the bowl when external load is applied to the shell.

The inner surface of the toilet bowl is plated for example with polytetrafluoroethylene or another non-stick coating. This is known per se in vacuum toilets. The shell is of glass-fiber reinforced plastic. This gives a structure which is light but strong enough.

The invention is not limited to the embodiments shown, but several modifications thereof are feasible within the scope of the attached claims.

We claim:

1. A vacuum toilet unit comprising a toilet bowl, operating means for the toilet function, said operating means including a sewer valve and a control device for controlling operation of the sewer valve, and the toilet unit also comprising an outer shell which encloses the toilet bowl and isolates the operating means from a user of the toilet bowl, wherein at least a substantial portion of the shell is removable from the toilet bowl without any substantial influence on the support of the bowl or said operating means in order to allow service access to the operating means and substantially all of the externally applied load exerted by a user of the toilet is carried by the shell.

2. A vacuum toilet unit according to claim 1, wherein the outer shell includes a bowl-supporting part and a detachable part and wherein the toilet bowl is supported by the bowl-supporting part of the outer shell and the detachable part of the shell is removable from the bowl-supporting part to provide service access to said operating means without removing support for the toilet bowl.

3. A vacuum toilet unit according to claim 2, comprising a shell support means for supporting the bowl-supporting part of the shell and wherein the bowl-supporting part of the shell is fixed relative to the shell support means and the detachable part of the shell is supported by the bowl-supporting part of the shell.

4. A vacuum toilet unit according to claim 3, wherein the detachable part of the shell is removable from the bowl-supporting part of the shell without use of a tool.

5. A vacuum toilet unit according to claim 2, wherein the bowl-supporting part is a lower part of the shell in enclosing relationship with the toilet bowl.

6. A vacuum toilet unit according to claim 5, wherein the detachable part of the shell has a lip portion at a lower edge thereof extending outside the bowl-supporting part of the shell and downward of an upper edge of the bowl-supporting part of the shell.

7. A vacuum toilet unit according to claim 2, wherein one of said parts of the outer shell is an upper part and includes a skirt portion extending into the toilet bowl and limiting inwardly a flush annulus.

8. A vacuum toilet unit according to claim 2, wherein the bowl-supporting part of the shell is a lower part of the shell and has an upper support surface and the toilet bowl has a flange-like portion at or in the vicinity of an upper edge thereof, said flange-like portion being supported on the support surface of the bowl-supporting part of the shell.

9. A vacuum toilet unit according to claim 8, wherein the detachable part of the shell is an upper part thereof and is supported by the support surface of the bowl-supporting part of the shell.

10. A vacuum toilet unit according to claim 2, wherein the bowl-supporting part of the shell includes an attachment flange for securing the bowl-supporting part of the shell to the wall.

11. A vacuum toilet unit according to claim 2, wherein one of said parts of the shell is an upper part and the toilet unit comprises a seat element attached to the upper part of the shell.

12. A vacuum toilet unit according to claim 11, comprising a toilet bowl cover attached to the upper part of the shell.

13. A vacuum toilet unit according to claim 2, wherein the shell is made of a fiber-reinforced synthetic polymer material.

14. A vacuum toilet unit according to claim 1, comprising a bowl support means for supporting the toilet bowl and the operating means, and a shell support means for supporting the outer shell at a sufficient clearance relative to the toilet bowl that no substantial load is transmitted from the outer shell to the toilet bowl when the toilet unit is in use, and wherein the outer shell is demountable from the shell support means to provide service access to said operating means without removing support for the toilet bowl and the operating means.

15. A vacuum toilet unit according to claim 14, wherein the bowl support means is dimensioned for supporting the weight of the toilet bowl and the operating means during servicing of the toilet unit and the shell support means supports external loads acting on the toilet unit during normal use of the toilet unit without substantially loading the toilet bowl and the bowl support means.

16. A vacuum toilet unit according to claim 14, comprising a seat element attached to the shell.

17. A vacuum toilet unit according to claim 14, comprising a toilet bowl cover attached to the shell.

18. A vacuum toilet unit according to claim 14, wherein the shell is made of a fiber-reinforced synthetic polymer material.

19. A vacuum toilet unit according to claim 1, wherein the operating means further includes a rinse water supply device which is supported independently of the shell, and wherein the control device controls operation of the rinse water supply device.

* * * * *